US008136964B2

(12) United States Patent
Hudson et al.

(10) Patent No.: US 8,136,964 B2
(45) Date of Patent: Mar. 20, 2012

(54) ILLUMINATED BOLLARD FOR LOADING DOCK

(75) Inventors: Dale R. Hudson, Jamesville, NY (US); Jay Tillman, Southbury, CT (US)

(73) Assignee: James Enterprises LLC, East Syracuse, NY (US)

( * ) Notice: Subject to any disclaimer, the term of this patent is extended or adjusted under 35 U.S.C. 154(b) by 418 days.

(21) Appl. No.: 12/545,894

(22) Filed: Aug. 24, 2009

(65) Prior Publication Data

US 2010/0052549 A1 Mar. 4, 2010

Related U.S. Application Data

(60) Provisional application No. 61/091,742, filed on Aug. 26, 2008.

(51) Int. Cl.
*F21V 21/29* (2006.01)
*F21S 13/10* (2006.01)

(52) U.S. Cl. ..... 362/276; 362/153; 362/431; 362/368

(58) Field of Classification Search ..... 362/276, 362/411, 394, 295, 368, 431, 362, 253, 234, 362/145, 153

See application file for complete search history.

(56) References Cited

U.S. PATENT DOCUMENTS

| | | | | |
|---|---|---|---|---|
| 3,696,240 | A | 10/1972 | Potter | |
| 4,973,016 | A | 11/1990 | Hertenstein | |
| 5,075,833 | A | 12/1991 | Dormond | |
| 5,709,458 | A | 1/1998 | Metz | |
| 6,183,112 | B1 | 2/2001 | Bomas | |
| 6,402,337 | B1 | 6/2002 | LeVasseur et al. | |
| 6,652,114 | B2 * | 11/2003 | Ancel | 362/147 |
| 7,101,064 | B2 | 9/2006 | Ancel | |
| 7,533,431 | B2 * | 5/2009 | Hochstein et al. | 362/427 |
| 2005/0254249 | A1 * | 11/2005 | Robbins, III | 362/485 |
| 2006/0109667 | A1 * | 5/2006 | Flaherty et al. | 362/431 |
| 2006/0133097 | A1 * | 6/2006 | Doric et al. | 362/401 |
| 2008/0010758 | A1 | 1/2008 | Hochstein et al. | |

* cited by examiner

*Primary Examiner* — Bao Q Truong
(74) *Attorney, Agent, or Firm* — Bernhard P. Molldrem, Jr.

(57) ABSTRACT

A combination dock light and bollard serves the purposes of both, without having any sensitive structure projecting out from the bollard into the traffic lane at the loading dock. A lamp assembly within the bollard projects out a window cutout at an upper end of the tubular metal body of the bollard. The lamp assembly rests on a sub-plate welded into the bollard below the cutout. The lamp holder is mounted on compression springs held in place with machine screw, to permit adjustment of the lamp beam direction. A photo eye turns the lamp on when the loading dock door is opened, and off when the dock door is closed.

12 Claims, 5 Drawing Sheets

ILLUMINATED BOLLARD FOR LOADING DOCK

RELATED APPLICATIONS

This application claims priority under 35 U.S.C. §119(e) of U.S. Provisional Pat. Application No. 61/091,742, filed Aug. 26, 2008, which is incorporated by reference herein.

BACKGROUND OF THE INVENTION

This invention relates to loading dock lighting systems, of the type intended to shine light inside a tractor trailer, van, railroad car, etc., when present at a loading dock at a warehouse or other shipping or receiving location. Loading vehicles, such as fork lifts and pallet lifters, are used in bringing goods and materials into a trailer or out of a trailer when the same is stationed at a loading dock. In order to help provide enough light for the fork lift operator during loading or unloading, it is often necessary to use a dock light. These items typically project from some structure, such as the edges or vertical guides of the dock door or gate, or can sometimes be installed on a post or bollard at the loading dock gate. One example of this is discussed in U.S. Pat. No. 7,101,064. These dock lights project out from the doorway or from the side of the bollard into the lanes that are traversed by the fork lifts or other equipment, and thus they are subject to collision damage. The docking equipment industry is aware of this problem, but has been unable to address it.

OBJECTS AND SUMMARY OF THE INVENTION

Accordingly, it is an object of the present invention to provide a dock light system that avoids the drawbacks of the prior art.

It is another object to provide a combination dock light and bollard that serves the purposes of both, without having any sensitive structure projecting out from the bollard into the fork lift traffic lane at the loading dock.

It is a more specific object to provide an illuminated bollard which is of simple construction, with clean lines and capable of providing good visibility into the interior of the truck or van being loaded or unloaded.

In accordance with one aspect of the present invention, an illuminated bollard is adapted to be installed adjacent a loading dock door and to provide illumination into a truck body or trailer positioned at the loading dock door and distally thereof. The illuminated bollard has a vertical tubular metal body (typically cylindrical, but possibly of other shapes); and a base plate that serves as a means for affixing the tubular metal body of the bollard to a horizontal floor surface. A window cutout is formed at an upper end of said bollard tubular metal body on a distal-facing side thereof (i.e., on the side looking out the dock door into the truck body or trailer). A fixed sub-plate is welded onto the inner surface of the tubular metal body below the window cutout, and a lamp assembly is seated on the sub-plate inside the upper end of bollard tubular metal body. The sub-plate can be in the form of a flange on the inner wall of the bollard tubular body, projecting radially inward a short distance and leaving an open core for electrical connections to conductors within the bollard.

The lamp assembly is made up of (a) a base plate adapted to rest upon the sub-plate; (b) a directional lamp supported on the base plate to provide a beam of light oriented generally horizontally and in the distal direction through the bollard window cutout; (c) an automatic sensor switch, such as an optical light switch, adapted to switch the lamp on when the loading dock door is opened and to switch the lamp off when the loading dock door is closed; and (d) a power supply that provides electrical power to the lamp. The directional lamp and optical light switch can be mounted onto, or above, the lamp assembly base plate. The directional lamp can include a lamp holder supported on compression springs held in place by long machine screws that pass through the holder and springs and into the base plate. The lamp holder is positioned so as to hold the lamp in a horizontal orientation, but also permit vertical adjustment of the lamp beam direction, and also permit some left to right adjustment of the lamp beam direction.

In a preferred mode, the illuminated bollard can have a plastic protective sleeve fitted over its tubular metal body, and the plastic sleeve has a window cutout therein aligned with the window cutout of the tubular metal body. Light from reflected from internal surfaces of the bollard illuminates the top of the sleeve, to increase visibility of the bollard.

Preferably, the sensor switch can be an optical switch, such as a photo eye unit operative to detect light (e.g., infrared) reflected from the loading dock door when the door is closed. To assist detection of reflected light, a strip of reflective tape can optionally be positioned on the dock door so that it is in alignment with the photo eye unit when the door is in its closed position.

The lens holder is supported on springs above the base plate, and these springs act to absorb some of the shock of collision with the fork lift or loading equipment and protect the lamp from damage.

An acoustic sensor, such as an ultrasonic or sonic detector, may be used rather than the optical switch to detect the presence of the door surface when the loading dock door is down or closed and to turn the dock light assembly on and off. A mechanical sensor, such as a microswitch with a wire whisker, may be used in some applications.

A metal mesh screen is positioned in the bollard window cutout to protect the lamp assembly.

The illuminated bollard may be present on one side only or on both sides of the loading dock door, as needed.

The above and many other objects, features, and advantages of this invention will be more fully appreciated from the ensuing description of a preferred embodiment, which is to be read in conjunction with the accompanying Drawing.

DETAILED DESCRIPTION OF THE PREFERRED EMBODIMENT

Figure 1:
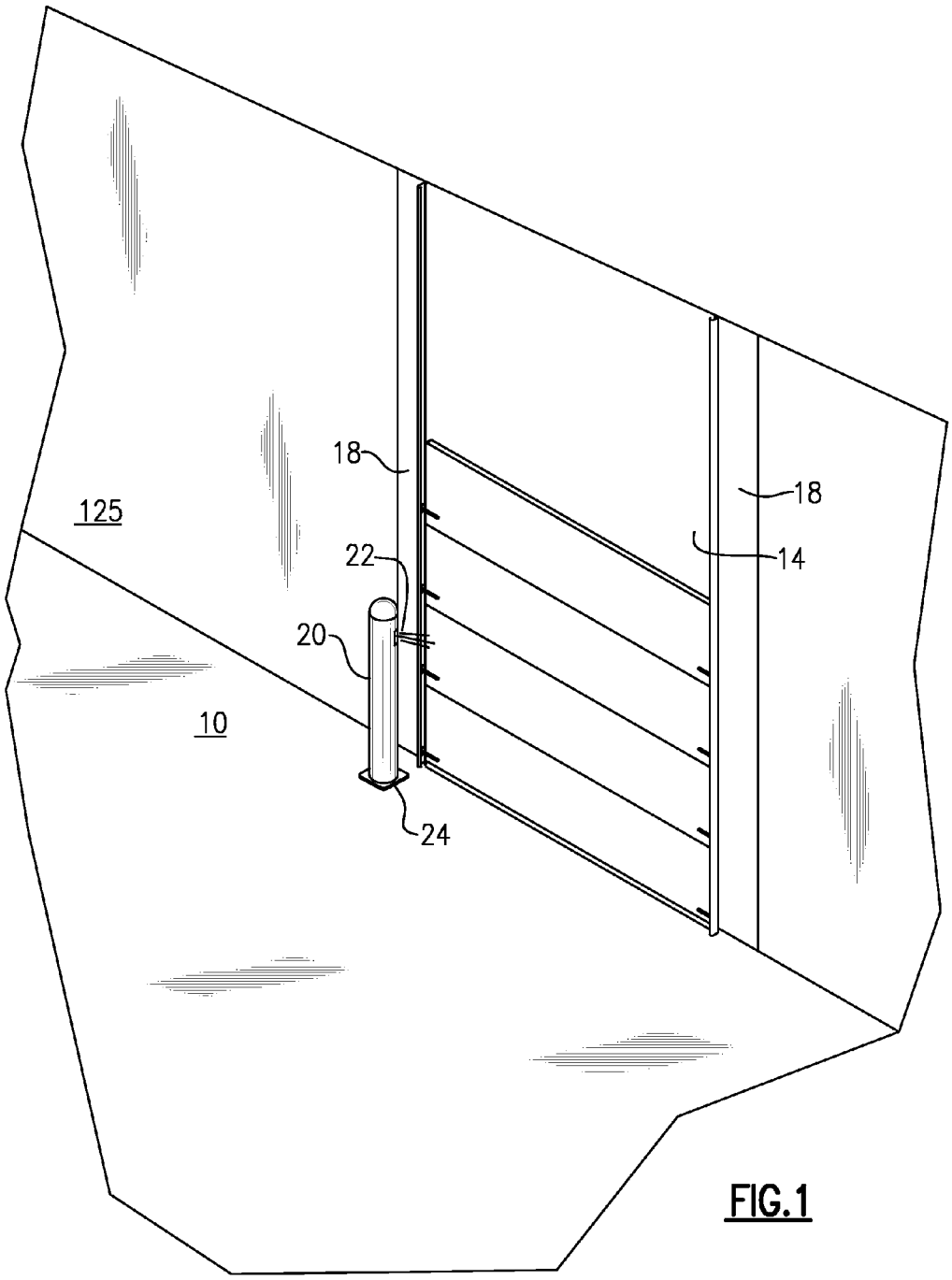
FIG. 1 is a perspective view of loading dock, employing an illuminated bollard according to one embodiment of the present invention.

With reference now to the Drawing, FIG. 1 shows the interior of a loading dock area of a warehouse or other shipping or receiving area, with a floor 10, wall surface 12, and a dock door 14. The dock door slides up and down in vertical door guides 18 at its left and right sides. The dock door 14 is opened, by lifting it upwards, to access the interior of a truck body, van, or trailer that has been parked or spotted at the dock gate.

A bollard 20, i.e., a strong steel post, is affixed to the dock floor 10 just in front of the door guide 18 to protect the door and guide from accidental bumping by a fork lift or other loading equipment as it goes through the open dock door 14 into and out of the truck that is being loaded or unloaded. Typically, there is a bollard at each side of the loading dock gate, but only one is shown here for purposes of simplicity. One of the two bollards is illuminated, and the other is of the standard type. The bollards can be cylindrical or pipe bollards, although other shapes could be used.

This bollard 20 is an illuminated bollard, with a lamp device or assembly within it, and which projects its light in the distal direction, through a window cutout or opening 22 on the distal side of the bollard, at or near the top thereof. Here, the window cutout 22 and the internal lamp assembly are about forty inches (e.g., 100 cm) above the floor or deck of the dock area. A mounting plate 24 is shown here at the base of the bollard 20 for permanently mounting the same to the floor. Depending on the lighting conditions inside the warehouse, and also depending upon the sensitivity of the equipment as discussed below, reflective tape may be applied to the dock door.

Figure 2:
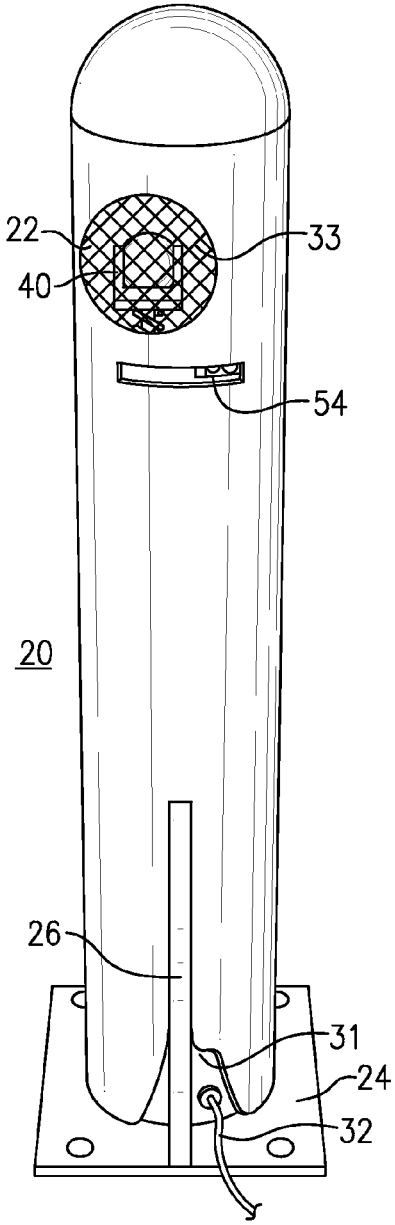
FIG. 2 is a front perspective view of the lamp assembly of this embodiment.
Figure 3:
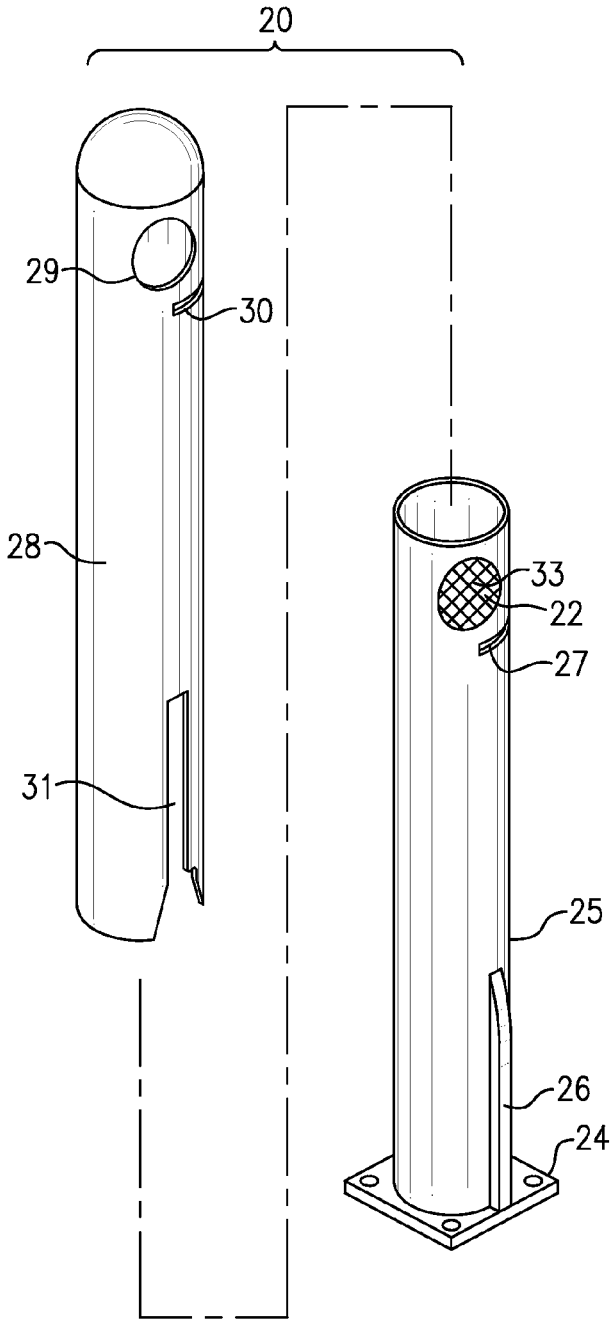
FIG. 3 is an assembly view of the illuminated bollard of this embodiment.

As shown in more detail in FIG. 2, the bollard 20 is in the form of a tubular cylindrical body 25, i.e., a metal pipe, with the window cutout 22 formed as a generally rectangular opening near the top end. As seen in FIG. 3 a support gusset 26 on the distal side of the tubular body 25 is affixed to the body 25 and to the mounting plate 24. Also, a protective plastic sleeve or cover 28 fits over the body 25, and this cover has a matching opening 29 that aligns with the bollard window opening 22. A rectangular opening 27 in the tubular body 25 below the window cutout 22 serves as a window for an infrared optical door sensor, to be discussed shortly, and there is a rectangular cutout 30 in the sleeve 28 that aligns with the rectangular opening 27 of the tubular metal body. There is a vertical slot 31, i.e, a keyway member that fits over the gusset 26, and serves to align the position of the sleeve 28 on the metal body 25, such that when the sleeve 28 is installed over the bollard body 25, that the two circular cutout 29 aligns with the window opening 22, and the rectangular cutout 30 aligns with the opening 27.

An electrical cord 32 emerges from the base of the bollard, as shown here, and can be plugged into a conventional power outlet. Alternatively, the bollard can be direct-wired.

A mesh screen 33 is affixed into the window 22 and serves to protect the lamp assembly 40 within the bollard 20 (the lamp assembly 40 is visible through the window 22 and screen 33 in FIG. 2). The screen 33 reflects some of the light produced from the lamp assembly, and this reflected light illuminates the top part of the sleeve, which is made of a translucent plastic material. This increases the visibility of the bollard when the lamp assembly is on. The mesh screen is omitted from the view in FIG. 5, but can be understood to be welded or attached with fasteners on the inner side of the window opening 22. A similar screen may be employed at the photo switch opening 27, if desired. In some possible embodiments, the screen or screens may be incorporated into the sleeve 24.

Figure 5:
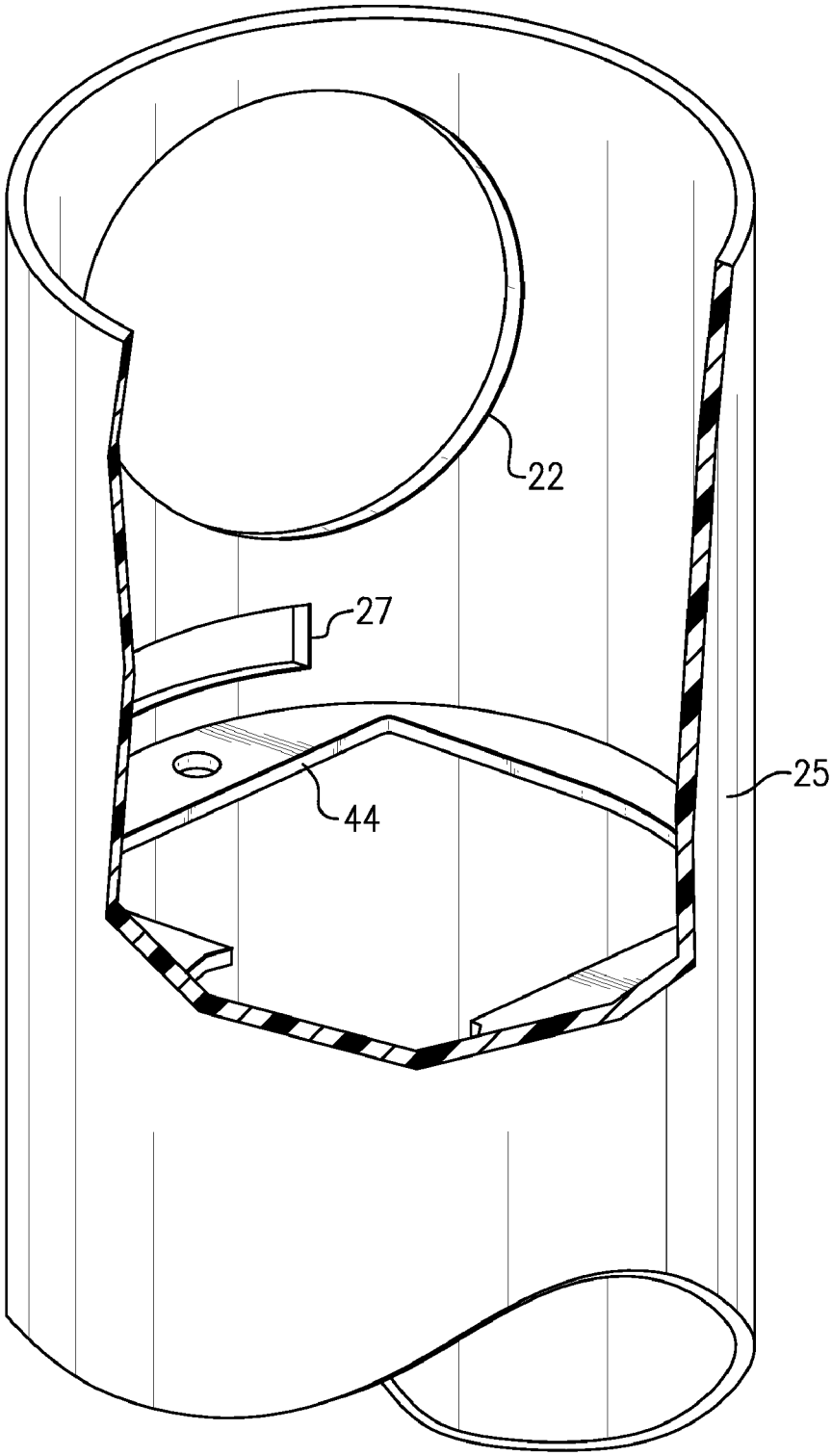
FIG. 5 is a perspective cutaway view of the top of the bollard tubular metal body.

The lamp assembly 40 can be removably installed through an open top of the tubular metal body 25. A base plate 42 of the light assembly 40 rests upon a sub-base 44 that is affixed horizontally to the inside surface of the tubular metal body 25 just below the lower edge of the opening 27. As shown in FIG. 5, this sub-base can be in the form of a flange that projects inward a short distance from the wall of the bollard tubular body 25, so as to leave an open central region.

Figure 4A:
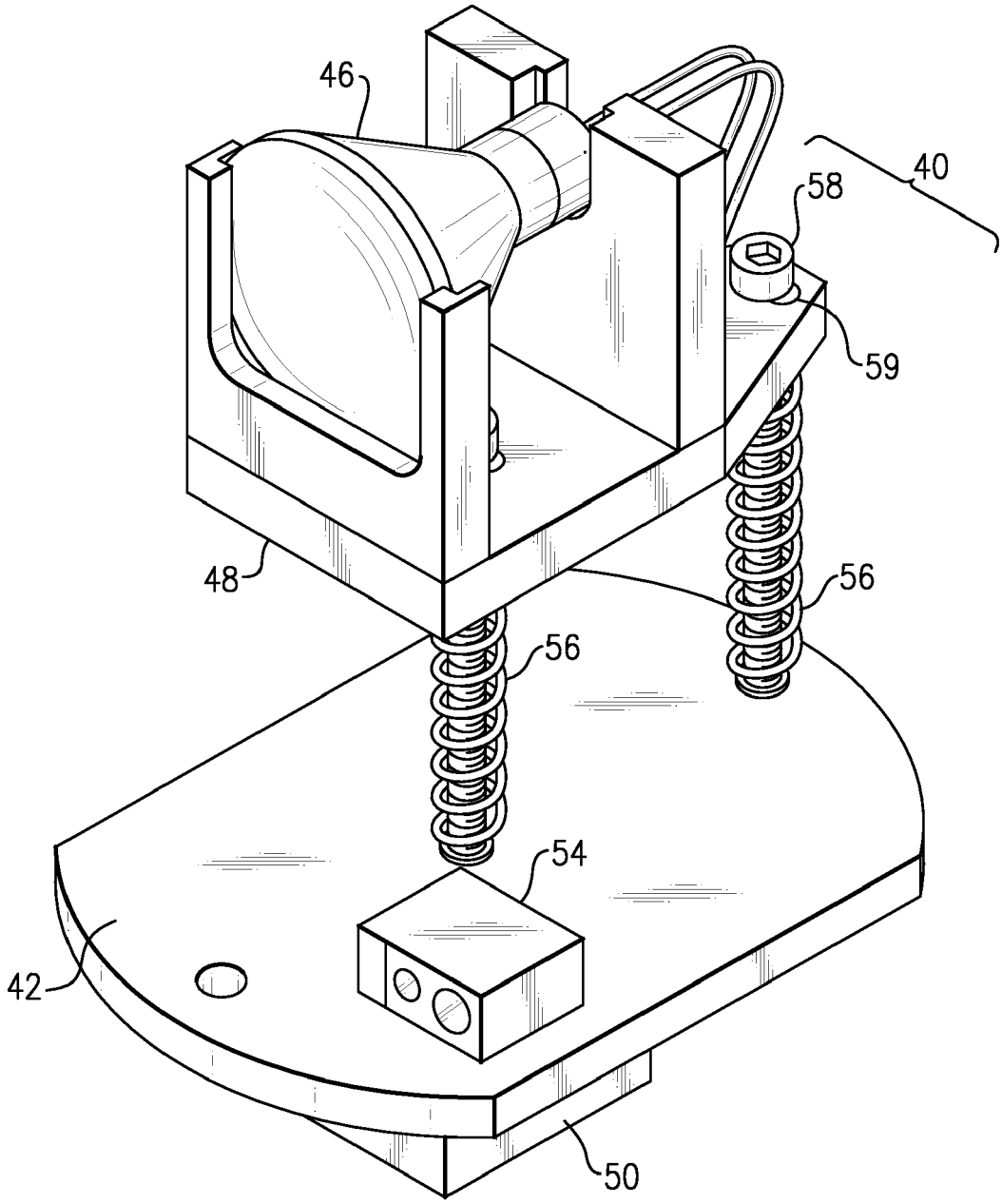
FIG. 4A is a perspective view of the lamp assembly.
Figure 4B:
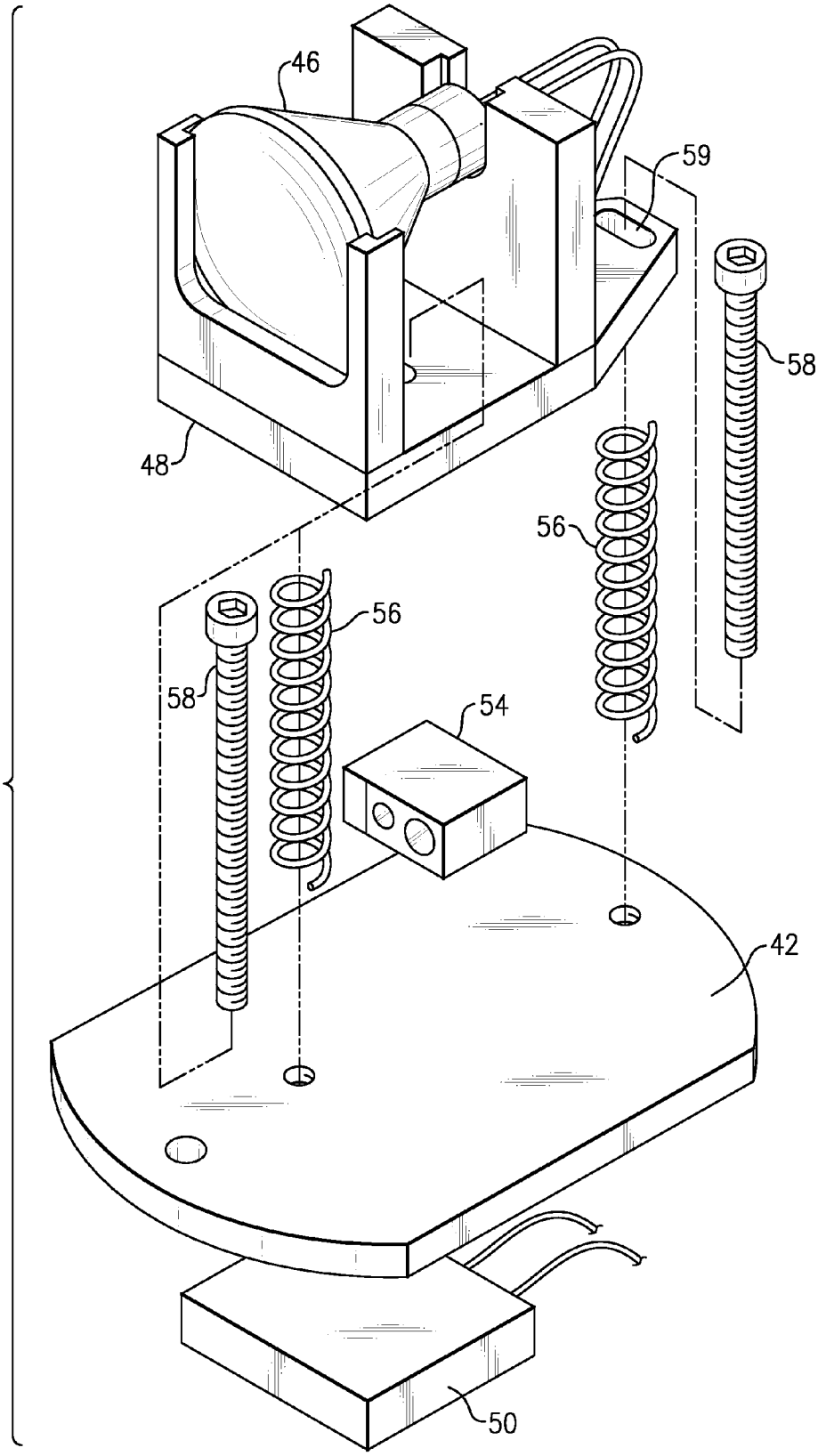
FIG. 4B is an assembly view of the lamp assembly of this embodiment.

On the light assembly as shown in exploded assembly view in FIG. 4B, and in perspective of FIG. 4A, a directional lamp 46, i.e., a reflector light or flood light, is held on a lamp holder 48 that is mounted above the lamp assembly base plate 42. A power supply 40 is mounted onto the lower side of the base plate 42. An electric eye or photo switch 54 uses visible light or other radiation that is reflected from the door 14, and which passes back through the bollard cutout 27, to turn the lamp 46 on when it detects that the door 14 has been lifted open, and to shut the lamp 46 off when it detects that the dock door 14 has been closed.

The lamp holder 42 has a base member that is supported on compression springs 56, which are held in place with long machine screws 58 or equivalent threaded members, which pass through openings in the lamp holder 42, then through the springs 56 and into threaded openings in the base plate 42. There is an elongated, generally bow-shaped screw opening 59 at the back end of the lamp holder 42, and this allows some lateral movement of the back of the lamp holder, so that the lamp beam direction can be adjusted from left to right. The screws 58 can be adjusted up or down to change the vertical direction of the lamp beam, as well. Thus, the arrangement as shown here with the springs 56 and machine screws 58 allows for both lateral (left to right) and vertical (up and down) adjustment of the direction of the beam of the lamp 46. The springs also serve to cushion the lamp holder 46 against shocks in the event that a forklift or other vehicle collides with the bollard 20. In some embodiments, rubber grommets or cushions can be positioned to absorb the shock of collision to protect the lamp assembly.

The lamp assembly 40 can dropped into place on top of the fixed sub-base 44, as shown in FIG. 5, with the lamp 38 oriented to shine in a generally horizontal and distal direction, out through the bollard window cutout 22. The entire assembly is removable for repair or replacement, leaving the sub-base 44. A standard electrical connector (not shown here) may be used for quick connect and disconnect of the power supply 50 with the power conductors within the bollard tubular body 25.

As mentioned before, the bollard 20 can have a different profile, e.g., square or oblong, and the door open-close detection can be carried out by means other than the electric eye switch. The bollard lamp window cutout or opening 22 is round in this embodiment, but could just as well be another shape. In this embodiment there are separate cutouts 22 and 27 for the lamp and the photo switch, but in some embodiments, the two could use a common cutout or opening.

While the invention has been described with reference to specific preferred embodiments, the invention is certainly not limited to those precise embodiments. Rather, many modifications and variations will become apparent to persons of skill in the art without departure from the scope and spirit of this invention, as defined in the appended claims.

We claim:

1. Illuminated bollard adapted to be installed adjacent a loading dock door and to provide illumination into a truck body or trailer positioned at said loading dock door and distally thereof, the illuminated bollard comprising:

a vertical tubular body;

means affixing a base of said tubular body to a horizontal floor surface;

a window cutout formed at an upper end of said bollard tubular body on a distal-facing side thereof; and a lamp assembly disposed within the upper end of said bollard tubular body, and including:

(a) a base plate;

(b) a directional lamp supported over said base plate and providing a beam of light oriented in the distal direction through said window cutout;

(c) an automatic sensor switch adapted to switch said lamp on when said loading dock door is opened and to switch the lamp off when said loading dock door is closed; and (d) a power supply that provides electrical power to said lamp.

2. The illuminated bollard of claim 1 wherein said directional lamp, said automatic sensor switch, and said power supply are all mounted on said base plate.

3. The illuminated bollard of claim 2 wherein said directional lamp includes a lamp holder adjustably supported above said base plate to hold said lamp in a generally horizontal orientation.

4. The illuminated bollard of claim 3 wherein said means for supporting includes a pair of compression springs situated between said lamp holder and said base plate, and a pair of threaded screws passing through said lamp holder and said compression springs into said base plate.

5. The illuminated bollard of claim 4 wherein said lamp holder has a bow-shaped opening for one of said threaded screws to permit lateral adjustment of beam direction of said directional lamp.

6. The illuminated bollard of claim 1 comprising a plastic protective sleeve fitted over said tubular body, and having a window cutout therein aligned with the window cutout of said tubular body.

7. The illuminated bollard of claim 6 wherein said bollard tubular body and said sleeve have cooperating keyway means to ensure alignment of the window cutout of the sleeve with the window cutout of the tubular body.

8. The illuminated bollard of claim 1 wherein said automatic sensor switch includes an optical switch.

9. The illuminated bollard of claim 8 wherein said optical switch is positioned on said base plate and is optically aligned with a window opening in said bollard tubular metal body.

10. The illuminated bollard of claim 9 wherein said optical switch includes a photo eye unit operative to detect light reflected from said loading dock door when the door is closed.

11. The illuminated bollard of claim 1 wherein said sensor switch includes an acoustic sensor.

12. The illuminated bollard of claim 1 comprising a mesh screen affixed within the window cutout of said bollard tubular body.

* * * * *

UNITED STATES PATENT AND TRADEMARK OFFICE

CERTIFICATE OF CORRECTION

PATENT NO. : 8,136,964 B2
APPLICATION NO. : 12/545894
DATED : March 20, 2012
INVENTOR(S) : Dale R. Hudson It is certified that error appears in the above-identified patent and that said Letters Patent is hereby corrected as shown below:

Title Page

(73) Assignee:

"JAMES ENTERPRISES LLC" should read --JAMAS ENTERPRISES LLC--.

Signed and Sealed this
Twenty-ninth Day of May, 2012

David J. Kappos

David J. Kappos
*Director of the United States Patent and Trademark Office*